US007327101B1

(12) United States Patent
Chen et al.

(10) Patent No.: US 7,327,101 B1
(45) Date of Patent: Feb. 5, 2008

(54) SINGLE POINT SENSING FOR END OF LAMP LIFE, ANTI-ARCING, AND NO-LOAD PROTECTION FOR ELECTRONIC BALLAST

(75) Inventors: Timothy Chen, Aurora, OH (US); Ajay Karthik Hari, Mayfield Heights, OH (US); Gregory Alan Harper, Louisville, KY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 11/646,138

(22) Filed: Dec. 27, 2006

(51) Int. Cl.
*G05F 1/00* (2006.01)

(52) U.S. Cl. ..... 315/307; 315/289; 315/290; 315/276; 315/209 R; 315/273; 315/DIG. 5

(58) Field of Classification Search ..... 315/209 R, 315/225, 291, 307, 308, 121, 257, 258, 272, 315/273, 289, 290, 205, 244, 297, 362, 313, 315/DIG. 5
See application file for complete search history.

(56) References Cited

U.S. PATENT DOCUMENTS 4,471,268 A * 9/1984 Brown et al. ..... 315/178
5,055,747 A * 10/1991 Johns ..... 315/307
5,650,694 A 7/1997 Jayaraman et al.
5,808,422 A 9/1998 Venkitasubrahmanian et al.
6,008,592 A 12/1999 Ribarich
6,400,095 B1 6/2002 Primisser et al.
6,741,043 B2 5/2004 Prasad
7,211,966 B2 * 5/2007 Green et al. ..... 315/224
2007/0029943 A1 * 2/2007 Erhardt et al. ..... 315/209 R

* cited by examiner

*Primary Examiner*—Haissa Philogene
(74) *Attorney, Agent, or Firm*—Fay Sharpe LLP

(57) ABSTRACT

Systems and methods are disclosed that facilitate sensing a pulse in a ballast circuit for a lamp when the lamp is in an end-of-life (EOL) stage or when the lamp is experiencing an arcing conduction condition, such as may occur when a contact between the lamp and its holder is compromised. Upon sensing the pulse, a microcontroller may distinguish between EOL and arcing conditions based on detected pulse width(s), and may initiate an appropriate response. For instance, if the pulse is due to an arcing event, the microcontroller may interrupt lamp operation for a brief period before restarting the lamp to mitigate the arcing condition. If the pulse is caused by an EOL condition, the microcontroller may place the lamp in a preheat or restarting mode to hasten lamp failure. In either case, responses to the sensed pulse mitigate the occurrence of dangerously high lamp temperatures that may damage lamp sockets.

20 Claims, 7 Drawing Sheets

SINGLE POINT SENSING FOR END OF LAMP LIFE, ANTI-ARCING, AND NO-LOAD PROTECTION FOR ELECTRONIC BALLAST

BACKGROUND OF THE INVENTION

When designing lamps and associated circuitry, economic considerations are of paramount importance and often are the difference between an acceptable design and an optimal design. Modern lamps come in a variety of sizes to accommodate multiple design variations. For instance, a T8 lamp size is approximately one inch in diameter, while a T12 lamp is approximately one and a half inches in diameter. Other sizes are also available to meet designer and consumer needs.

The T5 lamp and ballast have gained increasing popularity due in part to its compact size and high lumen efficacy relative to other ballast-and-lamp systems. However, a small diameter lamp may raise certain concerns, especially when a lamp approaches the end of its life (EOL). For instance, some lamps' end caps can overheat due to a depletion of an emission mix in the filament as they approach the EOL stage, and due to a small spacing between the cathode and lamp wall. When this occurs, the lamp's end cap and holder may exceed a design temperature limit and detrimentally affect the safety and reliability of the lighting system. Accordingly, an unmet need in the art exists for systems and/or methodologies that facilitate detecting and/or avoiding an overheating condition in a lamp.

BRIEF DESCRIPTION OF THE INVENTION

According to one or more aspects, a system that facilitates single-point sensing of end-of-life, anti-arcing, and no-load protection for an electronic ballast may comprise a first capacitor, a second capacitor, and a diode that experience a step change in one or more of current and voltage upon the occurrence of a pulsing event in a first lamp connected in series with the first and second capacitors; and a controller that detects the step change in the one or more of current and voltage and initiates a responsive action to the pulsing event as a function of information associated with at least one pulse.

According to other aspects, a method of sensing an event in an electronic ballast may comprise starting a lamp that is operatively connected to the electronic ballast, determining whether at least one pulsing event has occurred by detecting a step change in current through at least one of an inductor and a winding of a cathode transformer in the ballast, and determining whether the pulsing event is associated with an end-of-life condition of the lamp or an arcing condition at a terminal of the lamp.

According to other features, a system that facilitates mitigating a hazardous condition in a lamp may comprise means for determining whether a step change in a current level has occurred means for determining whether a pulse width associated with the step change indicates that the step change was caused by at least one of an end-of-life condition for the lamp and an arcing condition at a lamp terminal, means for expediting lamp failure if the step change is determined to be caused by an end-of-life condition, and means for temporarily interrupting lamp operation for a predetermined period if the step change is determined to be caused by an arcing condition at a terminal of the lamp.

DETAILED DESCRIPTION OF THE INVENTION

Figure 1:
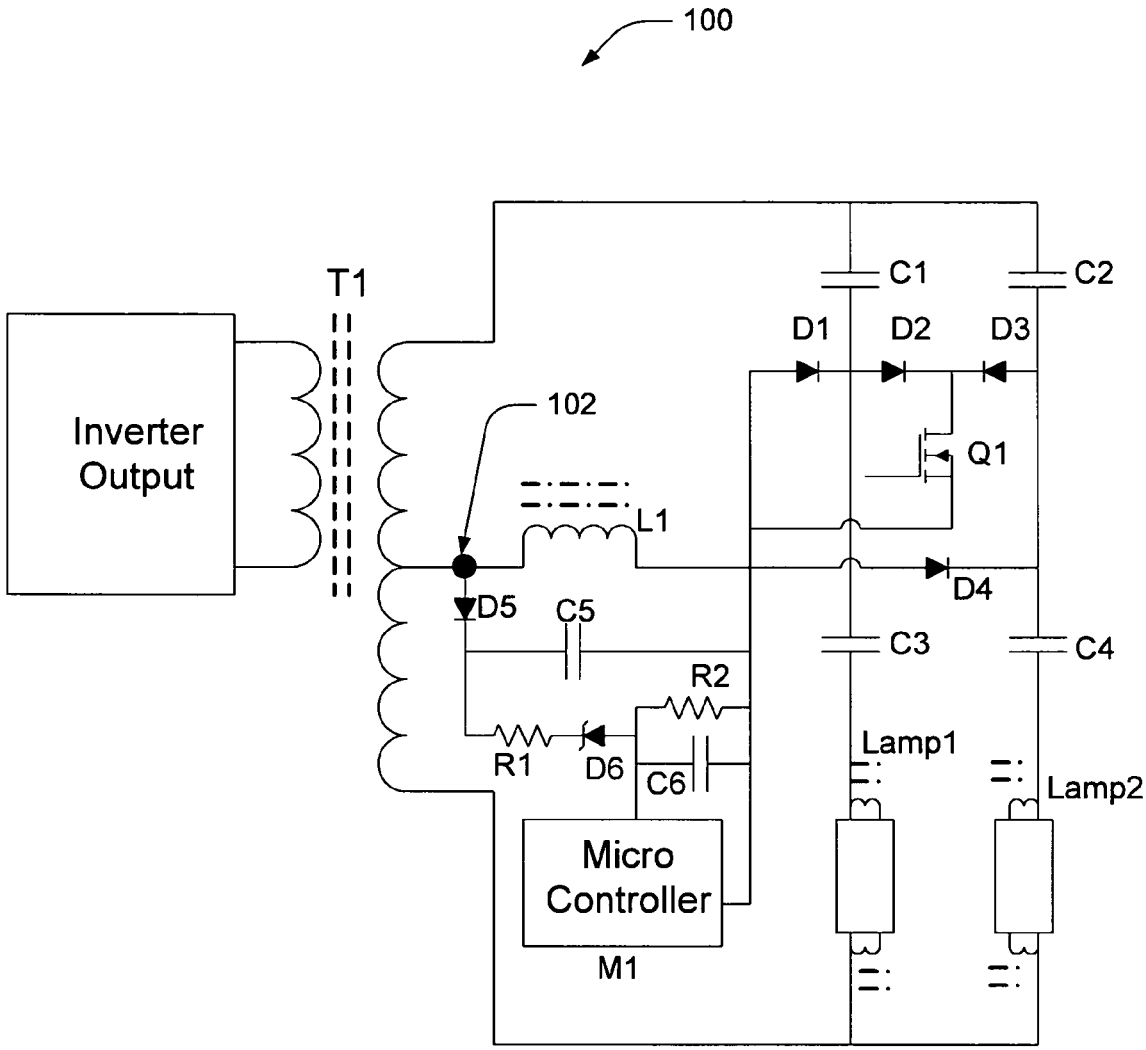
FIG. 1 illustrates a schematic diagram of a program-start ballast topography, wherein the ballast utilizes single-point voltage sensing for EOL detection, anti-arcing, and open load protection protocols.

Conventional ballasts implement lamps in series and senses lamp rectification by using either over-voltage (e.g., wherein the lamp increases voltage as the e-mix in the cathode depletes) or by sensing voltage developed on a DC blocking capacitor when the rectified current goes through it. If the measured voltage is outside of a window of predetermined minima and maxima, a protection circuit typically responds by shutting down the ballast.

However, there are many deficiencies associated with the over-voltage sensing approach. First, the ballast needs to be able to support multiple wattages and lamp lengths that operate at different voltages. Second, the problem becomes even more pronounced when two or more lamps operate in a series configuration. Ballasts designed with such a detecting method often do not work reliably and may cause malfunction, even when the lamp is in good condition. In some cases, a protection circuit may react by initiating a ballast starting sequence, re-lamping, or even wiring length of a fixture by shutting down the ballast. The aforementioned issues make such a ballast operation unreliable at best.

Another mechanism for EOL detection detects the presence of rectification or unbalance of a lamp current using a capacitor in series with the lamp. If the DC value across the capacitor is outside of a window of predetermine values, the circuit shuts down the ballast to prevent the lamp end cap and holder from overheating, and thereby protects the ballast. In an effort to increase lumen efficacy, some lamp designs employ Krypton (Kr) as a buffer gas to improve the efficacy and usefulness of the lamps. The high content of Kr often causes striations in the lamp, even when used in a non-dimming application. Some ballast designs inject a DC current into the lamp to improve lamp stability, but the added DC component may confuse the EOL protection circuit. Component tolerance and imbalance of the controller drive circuit further aggravate these issues.

Various no-load protection methods have also been developed by ballast designers to protect the ballast from a no-load condition and to reduce excess high voltage present at socket contacts. Often this involves either sensing a DC current path on the cathode or voltage across the lamp. Neither method provides adequate and quick protection for the switching devices and the integrated circuitry of the control; rather, a no-load condition may cause failures in many ballasts.

In accordance with various aspects described herein, an end of lamp's life (EOL) detection/protection circuit in a ballast design facilitates preventing overheating caused by a lamp EOL mode is described herein. Typically, there are three modes exhibited when a lamp is near end of life: pulsing on the lamp; asymmetric power dissipation; and open filament in one or two lamp cathodes. This application presents a pulse sensing circuit and programming routine for detecting symmetrical and/or asymmetrical pulsing when the lamp is at EOL or in an arcing conduction due to poor contact between the lamp and its holder. In either case (EOL or arcing), a step change in the lamp's current occurs, and the voltage across current-limiting capacitors in series with the lamp decreases. In response to the step change, a step high current peak goes through the primary windings of a cathode heating transformer; this in turn develops a high peak voltage across the windings. The analog circuit may process the peak voltage signal via a sample-and-hold circuit initially, and a microcontroller may further process the signal. The subject innovation comprises a one-point sensing approach utilizing programming power to determine whether the lamp is in an EOL stage or experiencing an arcing condition, and then responds accordingly. Finally, a no load detection circuit is also incorporated into the single point sensing technique for series and/or parallel lamp configurations.

An arcing phenomenon may be exhibited when there is intermediate contact between a lamp and a holder or socket into which the lamp is placed, as well as during a hot re-lamp period, and may overheat the lamp's holder and other fixture components. Many ballasts sold on the market today are without anti-arcing protection. Arcing in the output, similar to the pulse exhibited by a lamp in EOL phase, appears on a single sense point; however, the peak duration is longer for the arcing pulse than the EOL pulse. Therefore, programming may be utilized to identify a pulse time duration, which is in turn utilized to differentiate EOL from arcing. A long pulse width (e.g., greater than approximately 50 ms) is an indication of arcing presented at an output. The ballast 100 may respond to arcing in two different manners, depending on a customer's needs. For instance, one approach involves a shut-down and restart of the lamp, and then a shut-down of the ballast after detecting up to a predetermined number of arcs. Another approach involves removing arcing via temporary interruption of the output.

With reference to FIG. 1, a schematic diagram of a program-start ballast topography 100 is illustrated, wherein the ballast utilizes single-point voltage sensing for EOL detection, anti-arcing, and open load protection protocols. The ballast 100 may differentiate between EOL events and arcing events, and may respond to an arcing event in a manner that prevents unnecessary wear on the lamp that may otherwise occur if the arcing event were mistaken for an EOL signal. In accordance with various features of the subject innovation, the electronic ballast may be utilized for a T5 discharge lamp, as well as other lamp sizes (e.g., T8, T4, T1, T2, T3, or any other suitable lamp size). According to related aspects, the ballast circuit may be employed to provide a single sensing point for EOL detection, anti-arcing and no load protection for a parallel lamp T5 (or other size lamp) ballast. It will be appreciated that although the T5 lamp is described in connection with most aspects disclosed herein, any suitable lamp size may be employed in conjunction with the described innovation, and any and all such lamp sizes are intended to fall within the scope and spirit of the described features.

The circuit of FIG. 1 represents an example of a program start ballast topology that utilizes single point voltage sensing for EOL, anti-arcing and open load protections, wherein there are two capacitors, C1 and C3, in series with the lamp marked Lamp1. Capacitors C2, C4 and Lamp2 are duplicates of the first capacitor-lamp set for parallel lamp operation. The output winding of the transformer T1 is split in two sections: the switch Q1 and diodes D1, D2, D3, and D4, in conjunction with inductor L1 and microcontroller M1 in this configuration facilitate preheating, cathode voltage control, and starting. C1 and C3 are present to facilitate current-limiting of the lamp. Diode D5, capacitors C5 and C6, and resistors R1 and R2, facilitate EOL, anti-arcing and open load signal sensing. Single-point sensing may be facilitated by sensing current and/or voltage at node 102, according to various aspects.

As illustrated, Lamp1 and Lamp2 are arranged in a parallel configuration, which permits the microcontroller M1 to evaluate both lamps for EOL and/or arcing conditions concurrently. For instance, if Lamp1 is determined to be arcing, then a controller such as microcontroller M1, or any other appropriate or known hardware or software-based control device, may initiate anti-arcing protocols such as are described below with regard to FIGS. 5 and 6, while permitting Lamp2 to continue operating as normal. According to another example, Lamp2 may be in an EOL mode, which can trigger the microcontroller to initiate a failure sequence to ensure that Lamp2 does not pose a safety hazard while permitting Lamp1 to continue to operate normally. Thus, the parallel configuration can be employed to mitigate a need for complete shutdown of all lamps associated with the ballast circuit when responding to arcing and/or EOL conditions.

In the parallel lamp configuration of FIG. 1, the microcontroller M1 can evaluate step changes in capacitors C1 and C3 for Lamp1, and/or in capacitors C2 and C4 for Lamp2, indirectly via the current flow through D1 or D4, respectively, to determine whether an arcing or EOL event is occurring. For instance, the microcontroller M1 may evaluate and compare pulse width(s) associated with an arcing and/or EOL condition to determine whether the condition is present, and may distinguish between arcing and EOL conditions based on the pulse widths, since an arcing event is typically associated with a wider pulse than an EOL event.

Figure 2:
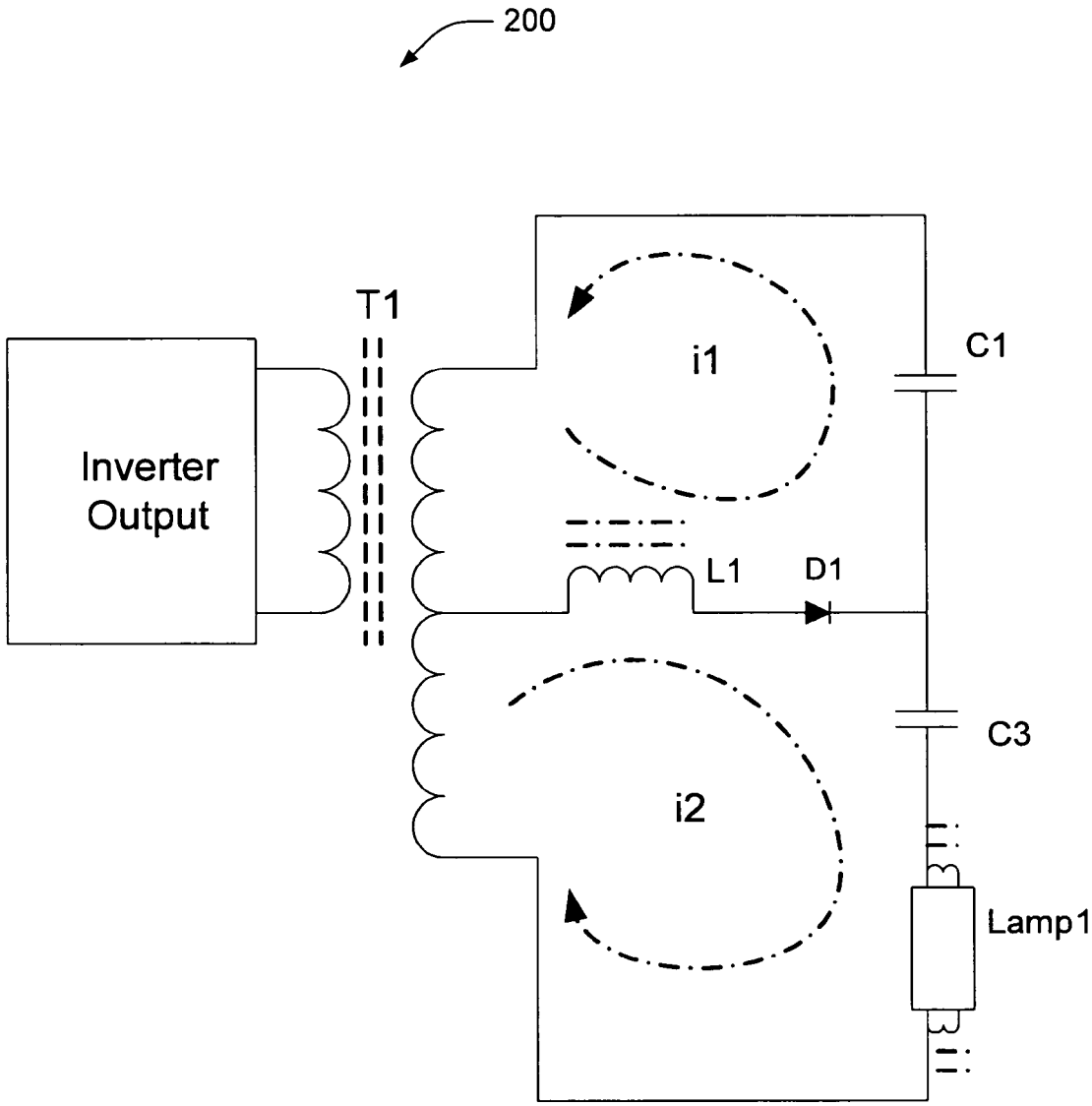
FIG. 2 illustrates a schematic diagram of a portion of a program-start ballast topography, which shows current paths through the topography when a lamp is in EOL or arcing mode.

FIG. 2 is an illustration of a schematic diagram of a portion of a program-start ballast 200 topography, which may be similar to the program-start ballast topography described above, and which shows current paths through the topography when a lamp is in EOL or arcing mode. For example, when a lamp is approaching EOL mode, a simultaneous current rectification and symmetric/asymmetric pulse may be observed. Various pulse durations (e.g., 3 ms on/3 ms off, 27 ms on/3 ms off, etc.) were tested for compliances. As shown in the FIG. 2, in EOL mode, the transition of the pulse from one state to another will cause a step voltage change on C1 and C3 (shown in FIG. 3, below). The step change causes a high $\Delta i/\Delta t$ current through the diode D1 to charge C1 and C3. The high $\Delta i/\Delta t$ current through the winding L1 generates high peak voltage across the inductor L1.

With reference to the components of FIG. 1, the waveform may be further processed with a peak sample-and-hold circuit comprising D5, C5, R1 and R2, and D6. The Zener diode D6 may be utilized to improve the signal to noise ratio (SNR), and C6 may be employed to filter out high frequency noise. The resulting waveform is shown below, in FIG. 4. The circuit is designed in such a manner that the minimum width of the signal may be larger than the maximum sampling rate of the microcontroller M1 used in the design. Upon detecting the EOL signal, the microcontroller M1 may place the ballast in preheat mode or shut-down mode for a preset time duration before restarting the lamps. According to some features, the ballast may be put in permanent shut-down mode once the EOL signal has been detected N times, where N is an integer and can only be reset by recycling the input power or by relamping. According to a more specific example, N may be equal to 3, although any other suitable number (e.g., 1, 2, 4, 5, 6, . . . ) may be selected in accordance with various designs and/or designer preferences.

Figure 3:
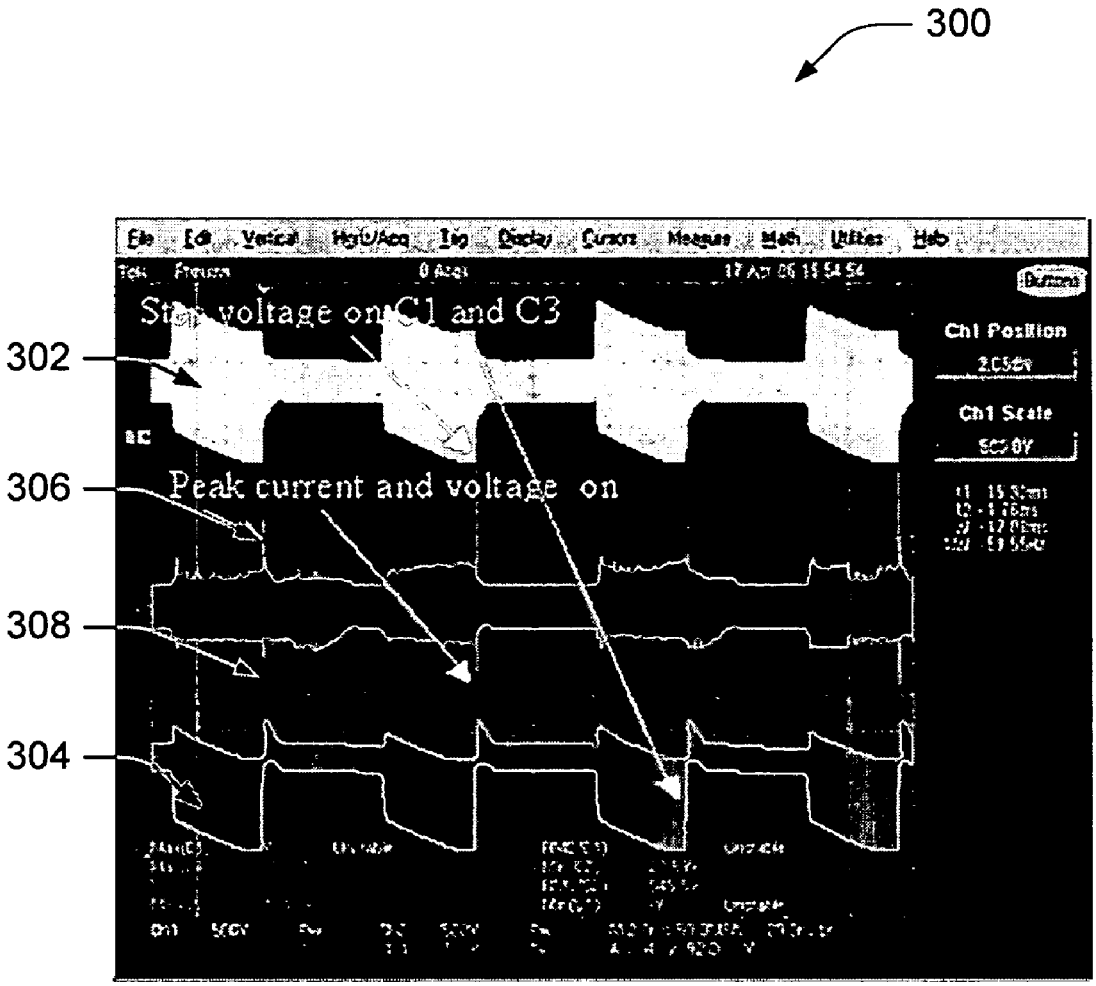
FIGS. 3 and 4 illustrate graphs of current and voltage across inductor L1 when a lamp is in EOL pulsing mode in accordance with various aspects.
Figure 4:
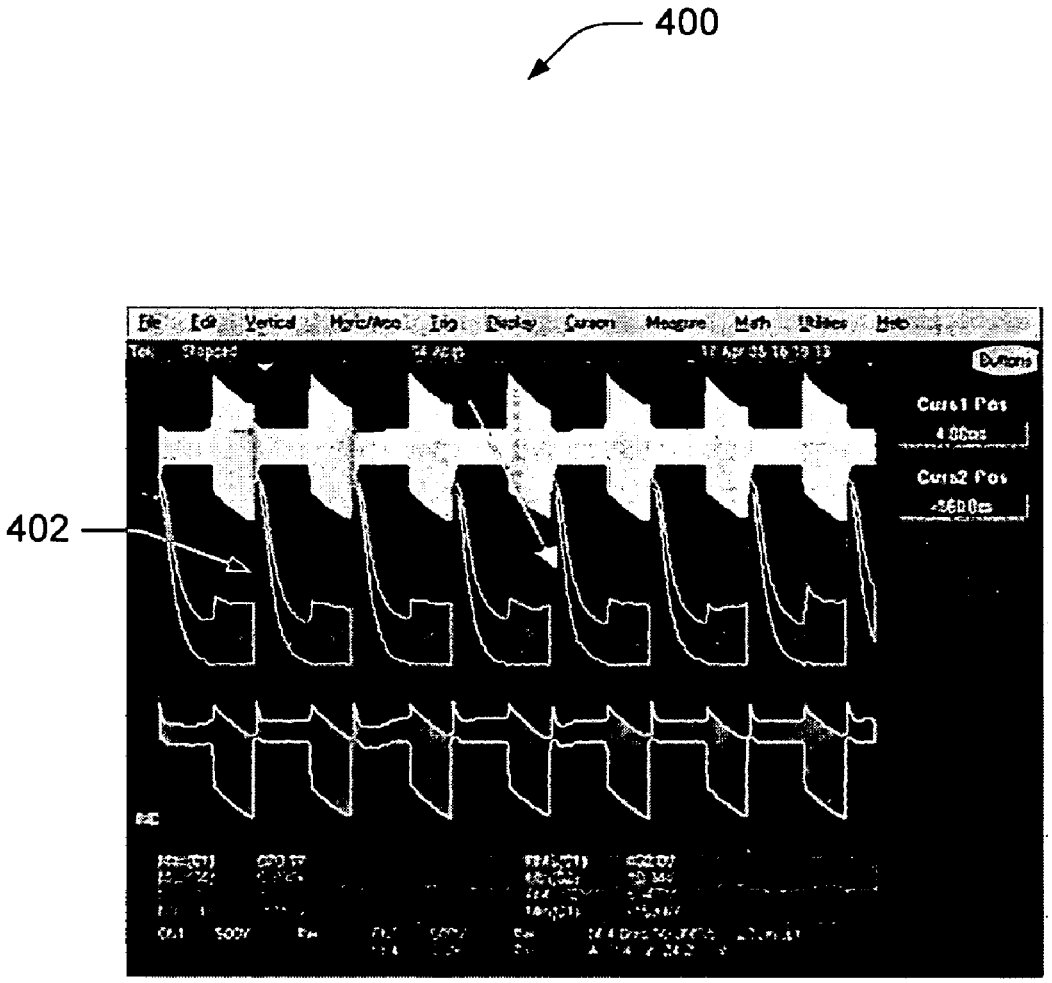

FIGS. 3 and 4 illustrate graphs 300 and 400 of current and voltage across inductor L1 when a lamp is in EOL pulsing mode in accordance with various aspects. For instance, FIG. 3 illustrates a voltage 302 across capacitor C1 of the preceding figures, and a voltage 304 across C3. A peak voltage 306 across inductor L1 is shown, as is a peak current 308 through inductor L1, before sample-and-hold and scale down protocols. FIG. 4 illustrates the voltage 402 across inductor L1 after such protocols, when the signal is conditioned for the analog-to-digital converter of the microcontroller, M1.

Figure 5:
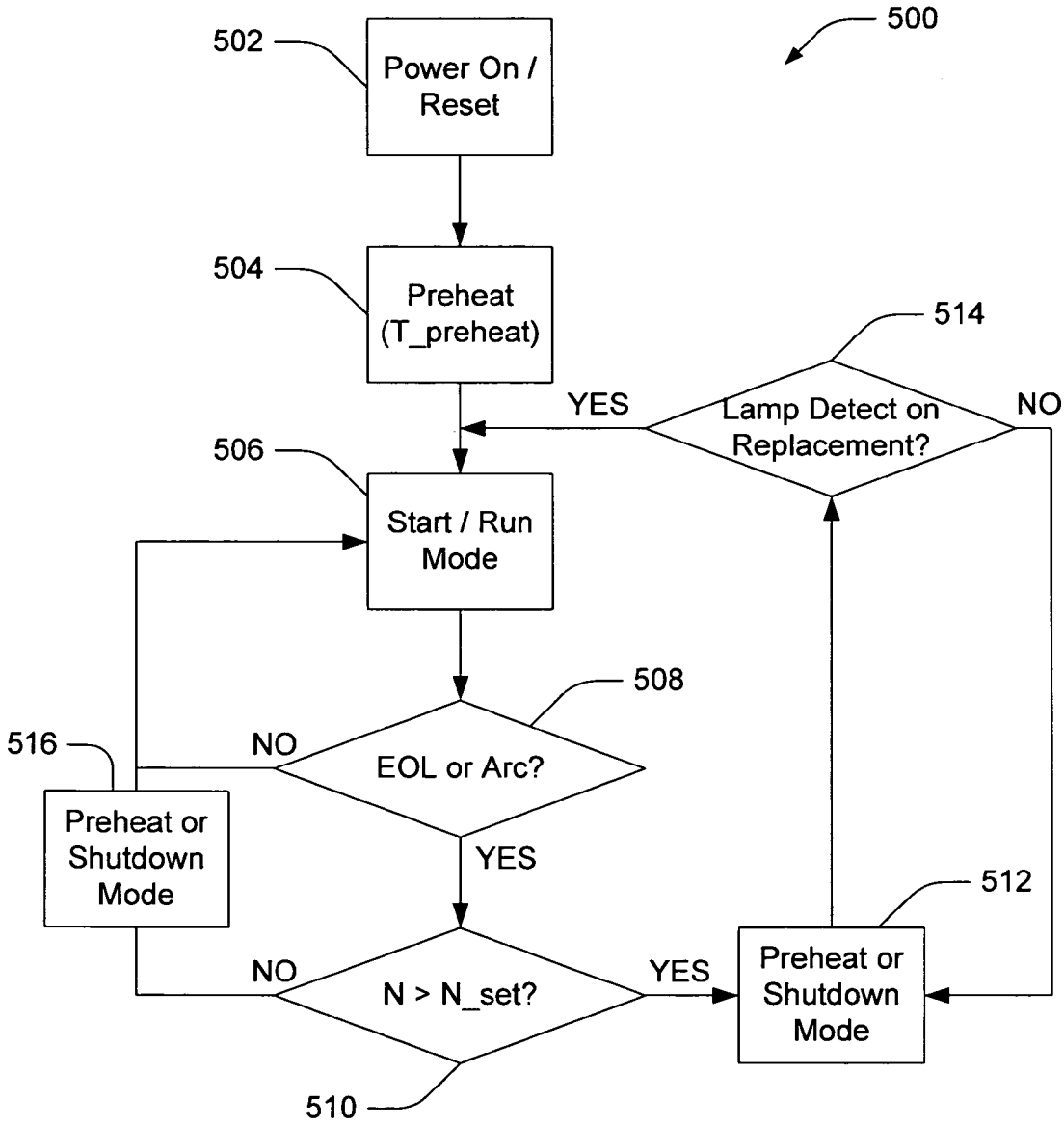
FIG. 5 illustrates a methodology for responding to arcing and/or EOL events in a lamp ballast after detecting a predetermined number of events, in accordance with various aspects.
Figure 6:
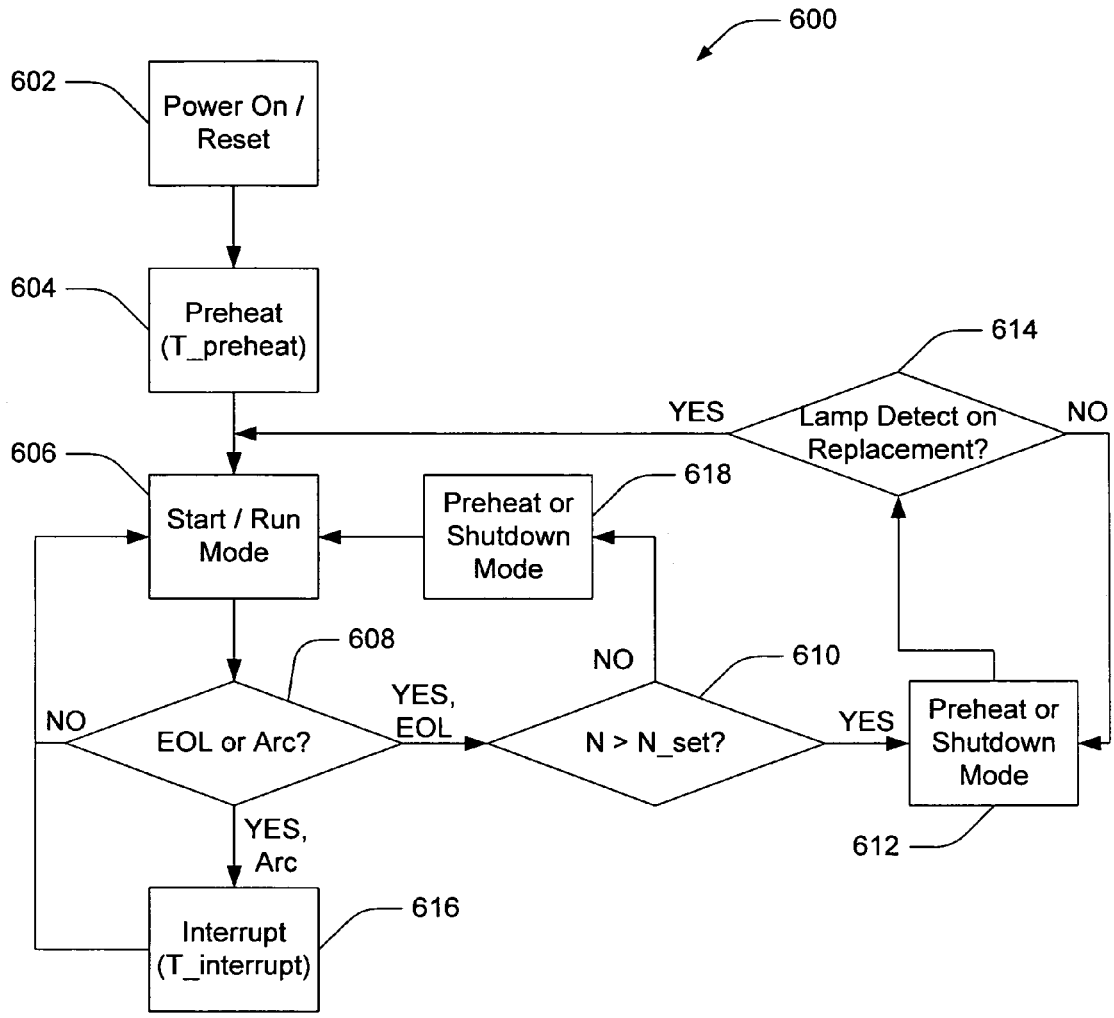
FIG. 6 illustrates a method for mitigating arcing via temporary interruption of lamp ballast output, in accordance with one or more features of the subject innovation.

With regard to FIGS. 5 and 6, methodologies are described that facilitate providing a parallel lamp ballast that permits single-point sensing for EOL, anti-arcing, and no-load protection protocols. The methodologies are represented as flow diagrams depicting a series of acts. However, it will be appreciated that, in accordance with various aspects of the described innovation, one or more acts may occur in an order different than the depicted order, as well as concurrently with one or more other acts. Moreover, it is to be understood that a given methodology may comprise fewer than all depicted acts, in accordance with some aspects.

FIG. 5 illustrates a methodology 500 for responding to arcing and/or EOL pulsing events in a lamp ballast after detecting a predetermined number of arcs, in accordance with various aspects. Methodology 500 facilitates mitigating potentially dangerous lamp conditions, such as overheating, melting of the lamp and/or lamp sockets by effectively encouraging lamp failure upon a determination that the lamp is at the end of its life or that an arcing condition is present. At 502, a lamp, such as a T5 lamp or the like, may power on after a period of being powered off or after being reset. At 504, the lamp may enter a period of preheating, which may be described as having a period, T, defined as T_preheat. Upon completion of the preheating period, the lamp may enter a start, or "run" mode, in which the lamp is maintained in an "on" state, at 506. At 508, a determination may be made regarding whether an arcing or EOL event has occurred or has been detected. The arcing event may be an electricity transfer such as may occur when there is an unintended or undesired intermediate contact between a lamp terminal and a holder or socket in which the lamp is situated, or may be an EOL pulsing event. If no EOL or arcing event is detected, the method may revert to 506 for continued operation of the lamp. In this sense, the loop between 506 and 508 represents a continuous monitoring-and-feedback loop that facilitates monitoring the lamp for an arcing or EOL event without disturbing operation of the lamp.

If an EOL or arcing event is detected at 508, then at 510, a determination may be made regarding whether a number of event occurrences, N, is greater than a predetermined threshold number of occurrences. For instance, a predetermined threshold, N_set, may be defined, and a determination may be made regarding whether the arcing event or EOL event has occurred more than N_set times. According to another example, N-set may be predefined as a number of arcing or EOL event occurrences that will trigger a response (e.g., with N being equal to or greater than N-set triggers a response). If N is less than (or in some aspects less than or equal to) N_set, then the method may proceed to 516 a brief period of preheating or shut down, then revert to 506 where lamp operation may continue without interruption.

If N is determined to be greater than N_set, then at 512 the lamp may be placed into preheat mode or shut-down mode. If the lamp is in an EOL stage, then placing the lamp into preheat mode at 512 may cause the lamp to burn out, thereby reducing the possibility of a potentially dangerous occurrence of lamp terminal overheating. Accordingly, at 514 a determination may be made regarding whether the lamp has been replaced. If not, then the method may revert to 512 for continued operation of the lamp in preheat mode or shut-down. In this case, the lamp is cycled through a shut-down and restart protocol a predetermined number of times, N, to ensure complete lamp failure to mitigate excessive temperature at a lamp terminal and to retain the parallel lamp operation. In the event that a new lamp is detected at 514, then the method may return to a start/run operation such as is described at 506. Additionally or alternatively, the method may revert to 504 for lamp preheating protocols and the like.

FIG. 6 illustrates a method 600 for mitigating arcing via temporary interruption of lamp ballast output, in accordance with one or more features of the subject innovation. Methodology 600 is similar to method 500 in that it facilitates encouraging complete lamp failure upon a determination that the lamp is at the end of its life. According to the method, at 602, a T5 lamp or the like may power on after being off or being reset. At 604, the lamp may enter preheating period, T_preheat. When the preheating period is concluded, the lamp may enter start/run mode, at 606. At 608, a determination of whether an arcing or EOL event has occurred or has been detected may be made. For instance, a step change in current is detected, then a pulse associated therewith may be evaluated and compared to one or more predetermined thresholds do facilitate differentiating between and EOL event and an arcing event. For example, since a pulse associated with an arcing event is typically of longer duration than a pulse associated with an EOL event, the determination at 608 may comprise comparing a detected pulse duration to a first predetermined threshold (e.g., an EOL event threshold pulse width or duration), as well as to a second predetermined threshold (e.g., an arcing pulse width or duration threshold). If the detected pulse is equal to or longer than the second predetermined threshold, then the method may proceed to 616. If the detected pulse duration is less than the second predetermined threshold, then the method may proceed to 610. If no EOL or arcing event is detected, the method may revert to 606 continued operation of the lamp.

If an EOL event is detected at 608, then at 610, a determination may be made regarding whether a number of EOL event occurrences, N, is greater than a predetermined threshold number of occurrences, N_set. According to another example, N_set may be predefined as a number of EOL event occurrences that will trigger a response (e.g., where N is equal to or greater than N_set triggers a response). If N is less than (or in some aspects less than or equal to) N_set, then the method may proceed to 618 for brief period of preheat or shut-down then revert to 606, where lamp operation may resume.

If N is determined to be greater than N_set, then at 612 the lamp may be placed into preheat mode or shut-down. Again, the lamp may be cycled through a shut-down and restart protocol a predetermined number of times, N, to ensure complete lamp failure to mitigate excessive temperature at a lamp terminal and retain parallel operation, i.e. the other good lamp in the system continues to operate. At 614 a determination may be made regarding whether the lamp has been replaced. If not, then the method may revert to 612 for continued operation of the lamp in preheat mode or shut-down mode until the input power is recycled. In the event that a new lamp is detected at 614, then the method may return to a start/run operation at 606. Additionally or alternatively, upon detection of a new lamp at 614, the method may revert to 604 for lamp preheating protocols and the like.

Alternatively, in the event that an arcing condition is detected at 608, then at 616 an interruption may be generated in the lamp's operation to facilitate mitigating the arcing condition and returning the lamp to normal operating conditions. The interruption may be on the order of microseconds or milliseconds in order to stop the arcing event and return the lamp to normal operation. Upon completion of the interruption period (e.g., T_interrupt), the method may revert to 606 for continued operation in run mode. In this manner, the method 600 may facilitate permitting a ballast in a lamp, such as a T5 lamp or the like, to distinguish between EOL pulsing events and arcing events, as well as to respond to such events in a manner that promotes extending lamp life when arcing is detected and truncating lamp life in favor of safety considerations when the lamp is determined to be near the end of its useful life.

Figure 7:
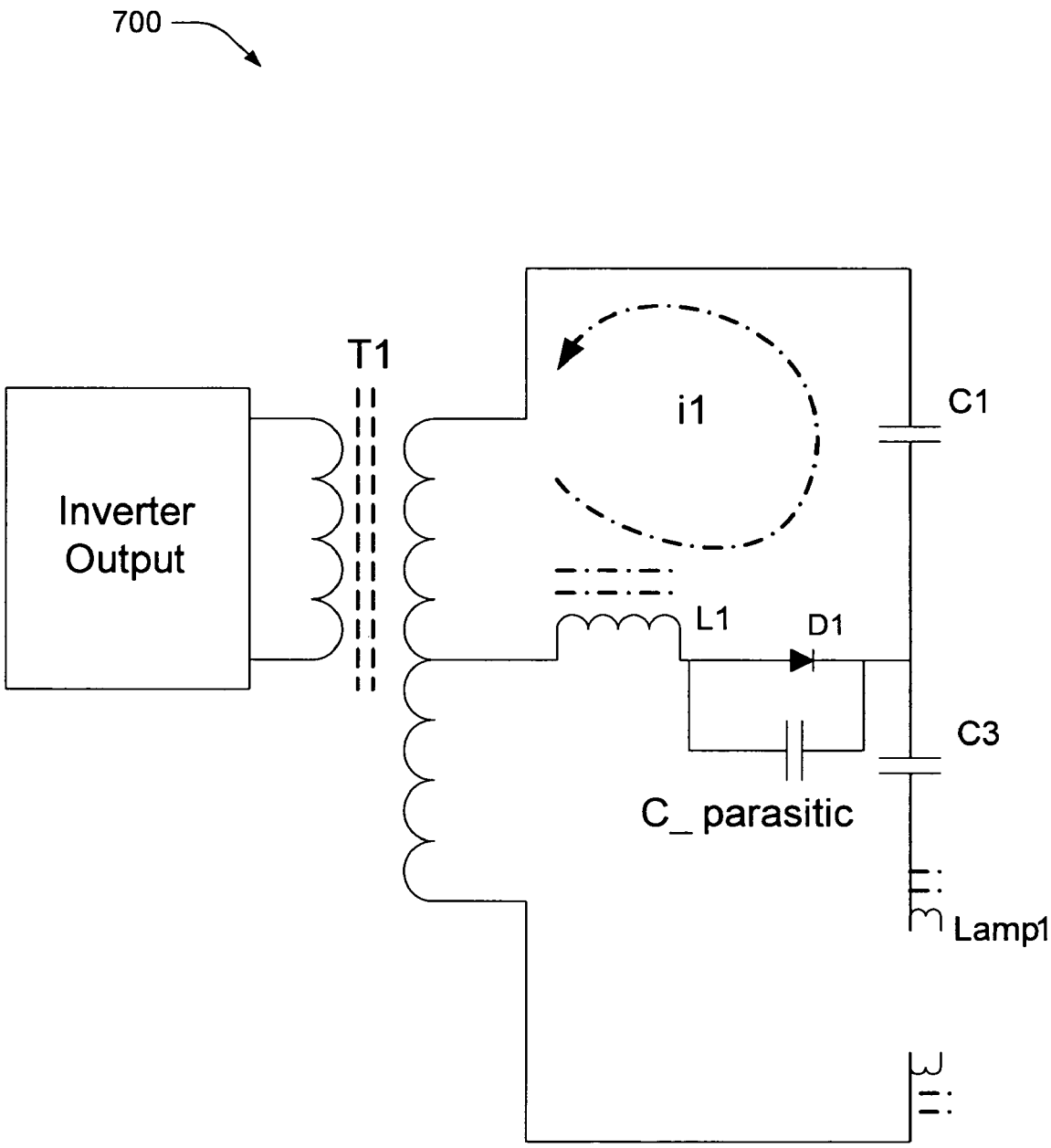
FIG. 7 illustrates a schematic diagram of a ballast circuit topology that facilitates providing no-load protection for a lamp, in accordance with various features presented herein.

FIG. 7 illustrates a schematic diagram of a ballast circuit topology 700 that facilitates providing no-load protection for a lamp, in accordance with various features presented herein. A capacitor labeled C_parasitic is an equivalent parasitic capacitor in parallel with diode D1. Within the current loop, "i1," there are three resonant components: L1, C1 and C1 parasitic. Ballast circuit 700 exhibits very low power loss because only the winding resistance, $R_{L1}$, of the inductor L1 loses power, and such power loss is minimal. L1, C1 and C_parasitic resonate with high Q (e.g., where $Q=\omega L_1/R_{L1}$, such that ω is equal to 2πf, and where $R_{L1}$ is the resistance associated with inductor L1). Accordingly, a high voltage may be developed on L1, and consequently the microcontroller M1 (e.g., of FIG. 1), which can place the ballast in shut down mode. In this manner, the ballast and/or the lamp associated therewith may be protected from an open-circuit condition that may otherwise detrimentally affect the lamp.

Below is a table of components and their respective reference characters to facilitate understanding of the various aspects and/or features described herein.

| Reference Character | Component |
|---|---|
| M1 | Microcontroller |
| C1 | Capacitor |
| C2 | Capacitor |

-continued

| Reference Character | Component |
|---|---|
| C3 | Capacitor |
| C4 | Capacitor |
| C5 | Capacitor |
| C6 | Capacitor |
| C_parasitic | Capacitor |
| D1 | Diode |
| D2 | Diode |
| D3 | Diode |
| D4 | Diode |
| D5 | Diode |
| D6 | Zener Diode |
| L1 | Inductor |
| Lamp1 | Lamp |
| Lamp2 | Lamp |
| Q1 | Switch |
| R1 | Resistor |
| R2 | Resistor |
| T1 | Transformer |

In accordance with one or more aspects, examples of values that may be associated with the various components are presented below. However, it is to be understood that the following values are presented for illustrative purposes only, and that the subject components are not limited to such values, but rather may comprise any suitable values to achieve the aforementioned goals and to provide the functionality described herein.

| Reference Character | Value/Type |
|---|---|
| M1 | PIC10F222 |
| C1 | 1000 Pf |
| C2 | 1000 Pf |
| C3 | 1200 Pf |
| C4 | 1200 Pf |
| C5 | 22 nf |
| C6 | 6.8 nf |
| C_parasitic | 30 pf |
| D1 | US1M |
| D2 | US1M |
| D3 | US1M |
| D4 | US1M |
| D5 | 1N4148 |
| D6 | 5 V |
| L1 | 1 turns |
| Lamp1 | F28W |
| Lamp2 | F28W |
| Q1 | BUL741 |
| R1 | 2.2 k |
| R2 | 240 k |

The above concepts have been described with reference to various aspects. Obviously, modifications and alterations will occur to others upon reading and understanding the preceding detailed description. It is intended that the concepts be construed as including all such modifications and alterations.

What is claimed is:

1. A system that facilitates single-point sensing of end-of-life, anti-arcing, and no-load protection for an electronic ballast, comprising:

a first capacitor, a second capacitor, and a diode that experience a step change in one or more of current and voltage upon the occurrence of a pulsing event in a first lamp connected in series with the first and second capacitors; and a controller that detects the step change in the one or more of current and voltage and initiates a responsive action to the pulsing event as a function of information associated with at least one pulse.

2. The system of claim 1, wherein the lamp is a T5 discharge lamp.

3. The system of claim 1, further comprising a second lamp with an associated pair of serially connected capacitors and a diode, wherein the second lamp and the first lamp are connected in parallel relative to each other.

4. The system of claim 1, wherein the information associated with the at least one pulse describes a width of the at least one pulse, and wherein the controller determines whether an end-of-life condition or an arcing condition is present as a function of the width of the at least one pulse.

5. The system of claim 4, wherein the controller stops and restarts the first lamp a predetermined number of times to permanently disable the lamp upon a determination that an end-of-life condition is present.

6. The system of claim 4, wherein the controller stops and restarts the lamp once upon a determination that an arcing condition is present.

7. A method of sensing an event in an electronic ballast, comprising:

starting a lamp that is operatively connected to the electronic ballast;

determining whether at least one pulsing event has occurred by detecting a step change in current through at least one of an inductor and a winding of a cathode transformer in the ballast; and determining whether the pulsing event is associated with an end-of-life condition of the lamp or an arcing condition at a terminal of the lamp.

8. The method of claim 7, further comprising analyzing pulse width for at least one pulse of a detected pulsing event to determine whether the pulsing event is associated with an end-of-life condition of the lamp or an arcing condition at a terminal of the lamp.

9. The method of claim 8, further comprising comparing the pulse width of the at least one pulse to predetermined threshold values.

10. The method of claim 9, wherein the pulsing event is determined to be associated with an end-of-life condition if the pulse width is greater than a first predetermined threshold, and associated with an arcing condition if the pulse width is greater than a second predetermined threshold.

11. The method of claim 10, wherein the second predetermined threshold is greater than the first predetermined threshold.

12. The method of claim 10, further comprising determining whether the at least one pulsing event has occurred more than a predefined number of times if an end-of-life condition exists.

13. The method of claim 12, further comprising placing the lamp into a preheat mode or shut-down mode if the at least one pulsing event has occurred more than the predetermined number of times.

14. The method of claim 13, further comprising detecting whether the lamp has been replaced.

15. The method of claim 14, further comprising maintaining the lamp in the preheat mode until the lamp is not operational if no replacement lamp is detected.

16. The method of claim 10, further comprising interrupting operation of the lamp for a predefined period if the pulsing event is determined to be an arcing condition at a terminal of the lamp.

17. The method of claim 16, wherein the predetermined period is approximately 50 ms.

18. The method of claim 7, wherein the lamp is a T5 discharge lamp.

19. A system that facilitates mitigating a hazardous condition in a lamp, comprising:

means for determining whether a step change in a current level has occurred;

means for determining whether a pulse width associated with the step change indicates that the step change was caused by at least one of an end-of-life condition for the lamp and an arcing condition at a lamp terminal;

means for expediting lamp failure if the step change is determined to be caused by an end-of-life condition; and means for temporarily interrupting lamp operation for a predetermined period if the step change is determined to be caused by an arcing condition at a terminal of the lamp.

20. The system of claim 19, wherein the lamp is a T5 discharge lamp.

* * * * *